US006942707B2

(12) United States Patent
Goraczko

(10) Patent No.: US 6,942,707 B2
(45) Date of Patent: Sep. 13, 2005

(54) VALORIZATION OF BY-PRODUCTS IN THE ECOLOGICAL COAL TRANSFORMATION

(76) Inventor: Adalbert W. Goraczko, 133 King Road, Pointe-Claire Quebec (CA), H9R 4H5

( * ) Notice: Subject to any disclaimer, the term of this patent is extended or adjusted under 35 U.S.C. 154(b) by 742 days.

(21) Appl. No.: 09/902,726

(22) Filed: Jul. 12, 2001

(65) Prior Publication Data

US 2002/0040574 A1 Apr. 11, 2002

(30) Foreign Application Priority Data

Jul. 12, 2000 (CA) ..... 2313882

(51) Int. Cl.[7] ..... C10L 5/00
(52) U.S. Cl. ..... 44/620; 44/903; 44/621
(58) Field of Search ..... 44/629, 620, 621, 44/608, 626, 903; 60/39.01; 201/27, 28

(56) References Cited

U.S. PATENT DOCUMENTS 1,519,784 A * 12/1924 Lomax et al. ..... 201/27
4,490,213 A * 12/1984 Anthony ..... 201/17
5,322,530 A * 6/1994 Merriam et al. ..... 44/608

* cited by examiner

*Primary Examiner*—Cephia D. Toomer
(74) *Attorney, Agent, or Firm*—Ogilvy Renault

(57) ABSTRACT

A coal transformation system comprises an ecological coal production unit for transforming raw coal into ecological coal. The production unit has an exhaust for carrying in a storage unit combustible, gaseous, waste by-products generated during the transformation of raw coal. A control system is provided for allowing the combustible, gaseous, waste by-products to be withdrawn and subsequently used as an additional source of energy when the system energy demand reaches a predetermined value, thereby contributing to reduce the energy costs during peak power needs.

7 Claims, 2 Drawing Sheets

VALORIZATION OF BY-PRODUCTS IN THE ECOLOGICAL COAL TRANSFORMATION

BACKGROUND OF THE INVENTION

1. Field of the Invention

The present invention relates to ecological coal and, more particularly, to the recovery and utilization of coal transformation by-products.

2. Description of the Prior Art

Ecological coal, characterized as smokeless coal, essentially consists of standard coal, which has been subject to a transformation process in order to produce a modified coal having high ignition facility, high energetic values, and low emission of dust, pitch and especially cancerigenic polycyclic aromatic hydrocarbons as compared with emissions from standard coal.

The ecological coal transformation process has been developed almost half a century ago. It was found to be an effective way of reducing, from raw coal, elements which are harmful to humans. However, ecological coal has not gained commercial acceptance yet, mostly since the cost of installation of the coal transformation plant and the exploitation costs thereof are prohibitive.

SUMMARY OF THE INVENTION

It is therefore an aim of the present invention to provide a method for reducing energy costs during predetermined periods in an industrial process.

It is also an aim of the present invention to provide a new ecological coal transformation system wherein coal transformation by-products are recovered and used as an additional source of energy.

Therefore, in accordance with the present invention, there is provided a method for reducing energy costs during set periods in an ecological coal transformation process, comprising the steps of: a) storing combustible by-products generated during transformation of raw coal into ecological coal, and b) using said combustible by-products as an additional source of energy during said set periods.

In accordance with a further general aspect of the present invention, there is provided a coal transformation system comprising an ecological coal production unit for transforming raw coal into ecological coal, an outlet for discharging combustible, gaseous, waste by-products from said ecological coal unit, a storage unit for storing the combustible, gaseous, waste by-products, a monitoring device for monitoring an energy demand for transforming raw coal into ecological coal, and a control system operatively connected to said monitoring device for allowing said combustible, gaseous, waste by-products to be withdrawn and subsequently used as an additional source of energy when the system energy demand reaches a predetermined value.

With the present invention, the ecological coal, is not as previously, considered as the only product of transformation. The process itself is now treated as a complex chemical operation, which besides coal briquettes release few other equally important products, which can be used to increase the profitability of the coal transformation process.

With the present invention, the process is economically viable, as the invention provides a way of recovering and using ecological coal transformation by-products.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
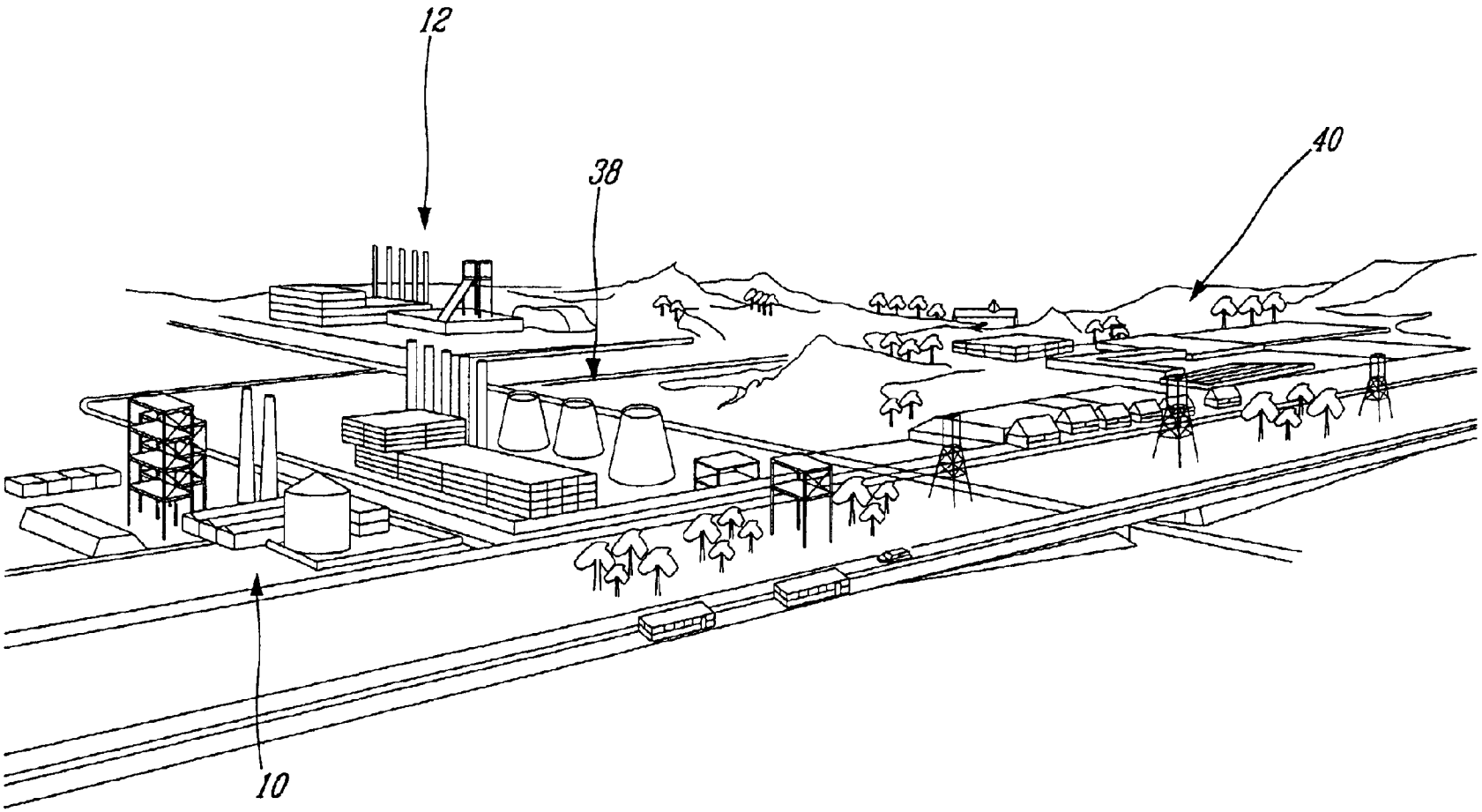
FIG. 1 is a perspective view of a mine, a thermo-power plant and a coal transformation plant in accordance with a first embodiment of the present invention.

FIG. 1 illustrates a transformation plant 10 for transforming raw coal into more environmentally friendly coal, characterized as ecological or smokeless coal. As seen in FIG. 1, the transformation plant 10 is preferably constructed near an existing mine 12. The raw coal is supplied to the transformation plant 10 from the mine 12.

The ecological coal production cycle used in accordance with the present invention is a modern, smokeless, wasteless method which essentially consists of briquetting hot carbonate, obtained in a process of pyrolysis of fine-grained power coal with heated up fine-grained baking coal in its maximum plasticity temperature (cca 450° C.).

The power coal and the baking coal used in the production of ecological coal should have the following properties:

| | power coal | baking coal |
|---|---|---|
| humidity | 8–11% | 8–12% |
| amount of volatile matter | <35% | <30% |
| amount of ash | cca 12% | cca 8% |
| amount of sulfur | <1 m9% | <0.6% |
| sinterability | max. 10 | >60 |
| calorific value | cca 23 MJ/kg | cca 30 MJ/kg |

The supplied power coal and baking coal are first grounded selectively by initial sifting of proper fractions on a bar screen and final grinding of leftovers to the following specific sizes:

power coal 80% less than 3 mm and 100% less than 6 mm baking coal 95% less than 3 mm and 100% less than 5 mm.

Such a grinding method contributes to reduce the amount of dust in the final product.

Figure 2:
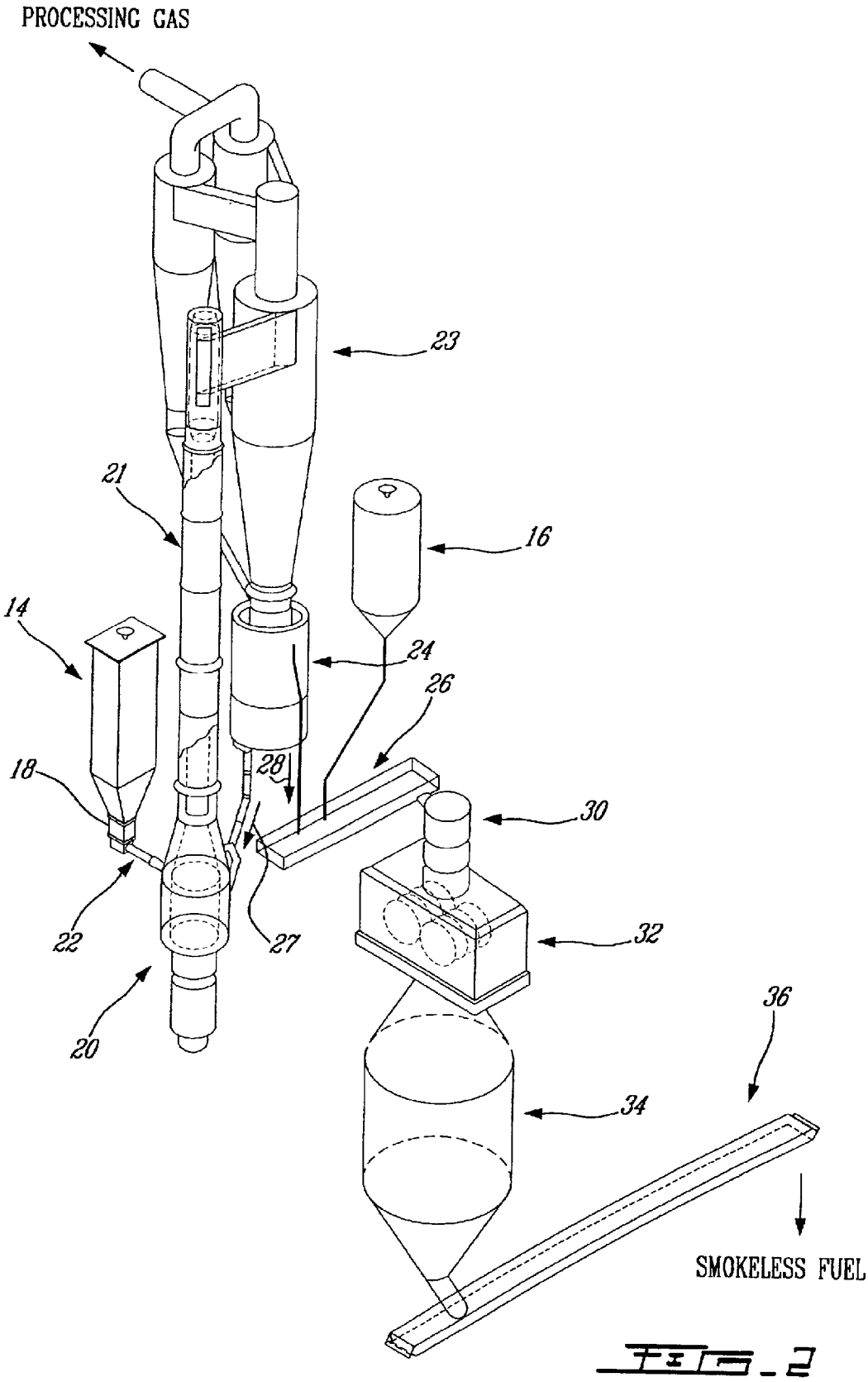
FIG. 2 is a perspective view of an installation used to transform raw coal into ecological coal.

The ground power and backing coal materials are then led to respective storage container 14 and 16 (see FIG. 2) where they can be stored for a certain period of time.

When it is desired to produce ecological coal, the pre-ground power coal is first led from the storage container 14 thereof to a fluidic drier 18, where it is diaphragmatically heated up with water steam to 120–130° C. Dried and heated power coal is then brought to a reactor 20 by means of worm gears 22. In the reactor 20, quick pyrolysis of coal is taking place at about 750° C., resulting in production of carbonate and a pyrolytic gas. The pyrolytic gas and the carbonate are carried away from the reactor 20 via a chimney 21 leading to a cyclone 23 where the pyrolytic gas is separated from the carbonate and dust. After having separated the pyrolytic gas from the carbonate and dust, the pyrolytic gas is withdrawn from the coal production unit via an outlet thereof and stored in a storage unit, such as a pressurized vessel, to be eventually used as an additional source of energy, for instance, during peak energy demand, as will be explained hereinbelow. The carbonate is discharged from the cyclone 23 into an intermediate container 24. Hot carbonate at 700–750° C. in the intermediate container 24 is batched with fluent rotation regulation to a pyrolysis temperature and can be partially returned to the reactor 20 in order to stabilize the process, as depicted by arrow 27. The excess of hot carbonate in the intermediate container 24 is directed to a horizontal mixer 26 in a briquetting spot, as illustrated by arrow 28 in FIG. 2.

The baking coal is dried and heated up to 200° C. and subsequently conducted to the horizontal mixer 26. The components (i.e. the dried and heated up baking coal and the carbonate) are mixed within 15–20 seconds and the mixture is dispatched to a mixer 30, where it "matures". "Maturing" consists of baking coal passing to the plastic state and its degassing (carbonization). The time required for getting "mature" can vary depending on the type of baking coal but, typically, it lies within a range of 2 to 6 minutes. The temperature of the briquetting mixture should correspond to the temperature of the baking coal maximum plasticity and is controlled by the temperature of the baking coal inlet to the horizontal mixer 26.

By means of a three-some thickener, the briquetting mixture is transported from the mixer 30 into a roll press 32, where crude briquettes are formed. Briquettes are transported to a container 34 for hardening. This process consists of auto-thermal treatment of briquettes sustained in a briquetting temperature for a period of 2.5–3 hours. Within that period briquettes are completely smoked off and baking coal is formed into a coke-like structure.

Briquettes are directed from the hardening container 34 through a unit of bar screens (not shown) to a briquette quencher (not shown), where they are cooled by immersion in water, and they are next directed to storage via an appropriate conveyor 36.

Before being loaded in rail cars (not shown), smokeless fuel briquettes are covered with emulsion in order to eliminate dusting during loading-unloading operations.

Each briquette has typically the following characteristics:

| | |
|---|---|
| dimensions | 64 × 50 × 34 mm |
| weight | 60 grams |
| humidity | <5% |
| amount of volatile matter | <16% |
| amount of ash | <15% |
| amount of sulfur | >0.7% |
| calorific value | <26 MJ/kg |

The briquettes are suitable for burning both in home coal furnaces and local heat boiler houses. It must be noted that because of specific progress of the process, heating productivity of devices when using ecological coal should increase by 15–20%.

There can be unorganized emissions during coal unloading and briquettes loading and boosting of transporting tracks of coal materials and briquettes. To avoid this it is planned to use:

cased conveyors sprinklers activated when necessary local ventilating draft with air cleaning through cloth filters.

Replacing coal with smokeless fuel briquettes makes it possible to reduce emissions during burning. Table 1.1 gives comparison of emissions observed during coal and smokeless fuel combustion.

TABLE 1.1

Comparative emissions measures during coal and smokeless coal combustion

| Emission of pollutants [mg/NH] | Smokeless coal | Coal |
|---|---|---|
| CO | <4000 | 2000–5500 |
| $SO_2$ | <400 | 350–700 |
| NoX | <150 | 110–180 |
| itch matter | <150 | 480–700 |
| benzo-α-pyrene [μG/MJ] | <80 | 400–600 |

By-process gases generated in processes of briquettes mixing, maturing, briquetting and hardening, after eliminating dust and heavy pitch fractions in a two-shaft pitch extractor (not shown), are directed for final cooling in coolers (not shown) and are then mixed with pyrolytic gas and jointly stored therewith for use as an additional source of energy when need be. Oil excess obtained in coolers is pressed within the reaction zone of the pyrolytic reactor 20. The pyrolytic gas and the other collected by-process gases formed a combustible gaseous by-product having the following standard constitution:

Table 1.2. Standard constitution of gaseous by-product

TABLE 1.2

Standard constitution of gaseous by-product

| No. | Component | Unit | Numeral values |
|---|---|---|---|
| 1 | $H_2$ | % vol. | 10.211 |
| 2 | CO | % vol. | 10.184 |
| 3 | $CH_4$ | % vol. | 7.00 |
| 4 | CnHm*) | % vol. | 1.757 |
| 5 | $CO_2$ | % vol. | 13.314 |
| 6 | N2 | % vol. | 56.321 |
| 7 | $O_2$ | % vol. | 0.578 |
| 8 | $SO_2$ | % vol. | 0.029 |
| 9 | $SO_3$ | % vol. | 0.014 |
| 10 | $H_2S$ | % vol. | 0.145 |
| 11 | NH3 | % vol. | 0.207 |
| 12 | HCN | % vol. | 0.240 |
| 13 | Pitch | g/m3 | 6.142 |
| 14 | Benzene | g/m3 | 2.680 |
| 15 | Water | g/m3 | 39.544 |
| 16 | Phenol | g/m3 | 0.250 |
| 17 | Dust | g/m3 | 0.030 |
| 18 | $C1^-$ | g/m3 | 0.100 |
| 19 | $F^-$ | g/m3 | 0.0007 |

*)n = 2, 17 m = 4, 45

Calorific value of gas is cca 6.000 kJ/$m_n^3$. Temperature of gas let out from the reactor is cca 850° C. Physical enthalpy makes cca 19% of gas stagnation enthalpy. A gas stream will be approximately 45.000 $m_n^3$/h.

Before being stored in a pressure vessel (not shown) the combustible gaseous by-product is passed through a quality control system (not shown). If there are no undesirable components, the by-product is directly led into the pressure vessel. However, if undesirable or harmful components are detected, the gaseous by-product is purified in an appropriate treatment system, such as an electric precipitator, before being stored. For instance, if it is necessary to remove $SO_2$ from the by-product, a waste sulfur removal installation (not shown) can be provided upstream of the pressure vessel.

A control system (not shown) is provided for computing the energy demand of the transformation process. When the energy demand increases to a predetermined value, as monitored by a suitable monitoring device, for instance during peak energy needs, the control system automatically commands the release of at least part of the stored by-product, which is then directed to a combustion chamber (not shown) where it is burned before being passed through a gas turbine (not shown) in order to provide an additional source of energy during peak energy consumption periods, thereby significantly reducing the energy costs associated with the operation of the transformation plant and, thus, the production costs of the ecological coal. For instance, this additional source of energy could be directly used in the coal transformation process or, alternatively, used as a source of energy in the heating and lighting systems of the coal transformation power plant.

The system energy demand is continuously monitored and when the energy demand reaches a predetermined threshold a signal is send to the control system for opening a valve or the like normally closing the pressure vessel containing the recovered by-process gases. A portion of the gases is then directed to a combustion chamber before being passed through a turbine to create energy.

Alternatively, the combustible gaseous by-products of the coal transformation process could be sold as a final product, for instance, to a thermo-power plant 38 (see FIG. 1) involved in electricity and steam generation. The combustible gaseous by-products would then be used as accessory fuel in boilers of the thermo-power plant 38.

The steam generated during the coal transformation process can also be retrieved and stored for subsequent utilization. For instance, the steam could be used in green houses 40 located at proximity of the coal transformation plant 10, as seen in FIG. 1.

It is also contemplated to respectively supplement the recovered by-product gases and the briquettes with hydrogen and oxygen produced from the electrolysis of a mass of water. The electrolysis operation could be carried on at night when the ecological coal production system is shut down or outside of the peak energy demand periods.

A simulation of economic profitability for various methods of air-pollution reduction was made. For the economic estimation various heating methods were compared. Single flat heating methods obtained by means of diverse furnaces and local boiler house were analyzed. Basic cost components were established, and so were the pollutants emitted whilst heating by means of furnaces a typical flat of 157 ml (60, 6 m,) cubical and power demand 5 kW. Coal-fired, smokeless oil-fired, gas-fired furnaces and electric heating were compared. The results of the estimations thereof are set in Table 1.3.

TABLE 1.3

| | Comparing costs and emissions from small coal furnaces | | | |
|---|---|---|---|---|
| Specification | Coal | Smokeless coal | Electric energy | Gas |
| Capital costs (USD) | 375 | 375 | 500 | 2500 |
| Fuel costs (USD) | 267.9 | 609.2 | 2057.1 | 1397.2 |
| Operating costs USD | 18.8 | 18.8 | 25.0 | 125.0 |
| Annual costs (USD) | 286.7 | 628.0 | 2082.1 | 1522.2 |
| Amortization (USD) | 12.5 | 12.5 | 16.7 | 83.3 |
| Credit return USD | 56.3 | 56.3 | 75.0 | 375.0 |
| Total annual costs | 355.5 | 696.8 | 2173.8 | 1980.5 |
| $SO_2$ emission (t) | 0.0921 | 0.0184 | 0 | 0 |
| Dust emission (t) | 0.1116 | 0.02678 | 0 | 0 |
| Pitch emission (t) | 2.79*10-2 | 0.033*10-2 | 0 | 0 |
| BaP emission (t) | 1.11*10-4 | 0.033*10-4 | 0 | 0 |
| USD/t $SO_2$ eliminated | — | 4631 | 19743 | 17644 |
| USD/t dust eliminated | — | 4024 | 16293 | 14561 |
| USD/t pitch eliminated | — | 13152 | 65200 | 58200 |
| USD/t BaP eliminated | — | 3.196*106 | 16.38*106 | 14.64*106 |

Comparing the data specified in Table 1.3 allows to conclude that using smokeless coal is the economically most effective way of pollution reduction. It should be pointed out that this method does not require any additional costs to users, since smokeless coal can be used in already functioning furnaces and coal boilers.

Taking into consideration the heat efficiency of ecological coal and unreserved costs of reducing emission by building factory-producing smokeless coal and costs of reconstruction of heating units and costs of gas or electric energy, one may state that, on an annual basis, ecological coal is from 2.5 to 6 times cheaper than the cost of using gas or electric energy (the multiplier depends on a scale of applied heating units).

What is claimed is:

1. A method for reducing energy costs during set periods in an ecological coal transformation process, comprising the steps of: a) storing combustible by-products generated during transformation of raw coal into ecological coal, and b) using said combustible by-products as an additional source of energy during said set periods, wherein step b) comprises the steps of: monitoring the energy demand, withdrawing at least part of said combustible by-products from a storage unit when the energy demand reaches a predetermined value, and converting the withdrawn combustible by-products into energy, wherein the step of converting the withdrawn combustible by-products is effected by burning the withdrawn combustible by-products so as to generate hot gases, and circulating said hot gases through a turbine to extract energy therefrom, and wherein said combustible by-products are stored under pressure into said storage unit.

2. A method as defined in claim 1, wherein said set periods are function of an energy demand associated with the industrial process.

3. A method as defined in claim 1, further comprising the steps of continuously monitoring said energy demand.

4. A method as defined in claim 1, further comprising the step of: controlling the quality of the combustible by-products before the same be stored in said storage unit.

5. A method as defined in claim 4, wherein the step of controlling the quality of the combustible by-products includes the step of withdrawing unwanted components from the combustible by-products.

6. A method as defined in claim 1, further comprising the step of mixing and storing pyrolytic gases with by-process gases generated while briquetting hot carbonate, obtained in a process of pyrolysis of fine-grained power coal with fine-grained baking coal heated up to a maximum plasticity temperature thereof.

7. A method as defined in claim 6, comprising the step of grinding the raw coal before transforming the same into ecological coal.

* * * * *